US008326638B2

(12) United States Patent
Tammi

(10) Patent No.: US 8,326,638 B2
(45) Date of Patent: Dec. 4, 2012

(54) AUDIO COMPRESSION

(75) Inventor: Mikko Tammi, Tampere (FI)

(73) Assignee: Nokia Corporation, Espoo (FI)

( * ) Notice: Subject to any disclaimer, the term of this patent is extended or adjusted under 35 U.S.C. 154(b) by 822 days.

(21) Appl. No.: 12/084,677

(22) PCT Filed: Nov. 4, 2005

(86) PCT No.: PCT/IB2005/003293

§ 371 (c)(1),
(2), (4) Date: May 5, 2008

(87) PCT Pub. No.: WO2007/052088

PCT Pub. Date: May 10, 2007

(65) Prior Publication Data

US 2009/0271204 A1 Oct. 29, 2009

(51) Int. Cl.
*G10L 19/00* (2006.01)

(52) U.S. Cl. ..... 704/500; 704/206; 704/220

(58) Field of Classification Search ..... 704/200, 704/500–504, 219–230, 205, 206, 207, 209
See application file for complete search history.

(56) References Cited

U.S. PATENT DOCUMENTS 7,024,357 B2 * 4/2006 Bartkowiak ..... 704/226
7,246,065 B2 * 7/2007 Tanaka et al. ..... 704/500
7,447,639 B2 * 11/2008 Wang ..... 704/503
7,555,434 B2 * 6/2009 Nomura et al. ..... 704/500
2004/0125878 A1 7/2004 Liljeryd et al.
2004/0176961 A1 9/2004 Manu et al.

FOREIGN PATENT DOCUMENTS

EP 1 441 330 7/2004

OTHER PUBLICATIONS

"Low power spectral band replication technology for the MPEG-4 audio standard" by Kok Seng Chong et al; Information, Communications and Signal Processing, 2003 and the Fourth Pacific Rim Conference on Multimedia. Proceedings of the 2003 Joint Conference of the Fourth International Conference, Publication Date: Dec. 15-18, 2003, vol. 3, pp. 1408-1411.

Chinese Office Action mailed May 12, 2010 in parallel Chinese Patent Application No. 200580051976.0 (7 pages) together with English translation thereof (9 pages).

Dietz, M. et al., *Spectral Band Replication, a Novel Approach in Audio Coding*, Audio Engineering Society, Convention Paper 5553, 112th Convention, Munich, Germany, May 10-13, 2002, 8 pages.

Ekstrand, P., *Bandwidth Extension of Audio Signals by Spectral Band Replication*, Proc. 1st IEEE Benelux Workshop on Model Based Processing and Coding of Audio (MPCA-2002), Leuven, Belgium, Nov. 15, 2002, pp. 53-58.

* cited by examiner

*Primary Examiner* — Huyen X. Vo
(74) *Attorney, Agent, or Firm* — Alston & Bird LLP

(57) ABSTRACT

For audio encoding and decoding, in order to enhance coded audio signals, the audio signal is divided into at least a low frequency band and a high frequency band, the high frequency band is divided into at least two high frequency sub-band signals, and parameters are generated that refer at least to the low frequency band signal sections which match best with high-frequency sub-band signals.

22 Claims, 5 Drawing Sheets

8

AUDIO COMPRESSION

TECHNICAL FIELD

The present application relates in general to audio compression.

BACKGROUND

Audio compression is commonly employed in modern consumer devices for storing or transmitting digital audio signals. Consumer devices may be telecommunication devices, video devices, audio players, radio devices and other consumer devices. High compression ratios enable better storage capacity, or more efficient transmission via a communication channel, i.e. a wireless communication channel, or a wired communication channel. However, simultaneously to the compression ratio, the quality of the compressed signal should be maintained at a high level. The target of audio coding is generally to maximize the audio quality in relation to the given compression ratio, i.e. the bit rate.

Numerous audio coding techniques have been developed during the past decades. Advanced audio coding systems utilize effectively the properties of the human ear. The main idea is that the coding noise can be placed in the areas of the signal where it least affects the perceptual quality, so that the data rate can be reduced without introducing audible distortion. Therefore, theories of psychoacoustics are an important part of modern audio coding.

In known audio encoders, the input signal is divided into a limited number of sub-bands. Each of the sub-band signals can be quantized. From the theory of psychoacoustics it is known that the highest frequencies in the spectrum are perceptually less important than the low frequencies. This can be considered to some extent in the coder by allocating lesser bits to the quantization of the high frequency sub-bands than to the low frequency sub-bands.

More sophisticated audio coding utilizes the fact that in most cases, there are large dependencies between the low frequency regions and high frequency regions of an audio signal, i.e. the higher half of the spectrum is generally quite similar as the lower half. The low frequency region can be considered the lower half of the audio spectrum, and the high frequency can be considered the upper half of the audio spectrum. It is to be understood, that the border between low and high frequency is not fixed, but may lie in between 2 kHz and 15 kHz, and even beyond these borders.

A current approach for coding the high frequency region is known as spectral-band-replication (SBR). This technique is described in M. Dietz, L. Liljeryd, K. Kjörling and O. Kunz, "*Spectral Band Replication, a novel approach in audio coding*," in 112th AES Convention, Munich, Germany, May, 2002 and P. Ekstrand, "*Bandwidth extension of audio signals by spectral band replication*," in 1st IEEE Benelux Workshop on *Model Based Processing and Coding of Audio*, Leuven, Belgium, November 2002. The described method can be applied in ordinary audio coders, such as, for example AAC or MPEG-1 Layer III (MP3) coders, and many other state-of-the-art coders.

The drawback of the method according to the art is that the mere transposition of low frequency bands to high frequency bands may lead to dissimilarities between the original high frequencies and their reconstruction utilizing the transposed low frequencies. Another drawback is that noise and sinusoids need to be added to the frequency spectrum according to known methods.

Therefore, it is an object of the application to provide an improved audio coding technique. It is a further object of the application to provide a coding technique representing the input signal more correctly with reasonably low bit rates.

SUMMARY

In order to overcome the above mentioned drawbacks, the application provides, according to one aspect, a method for encoding audio signals with receiving an input audio signal, dividing the audio signal into at least a low frequency band and a high frequency band, dividing the high frequency band into at least two high frequency sub-band signals, determining within the low frequency band signal sections which match best with high-frequency sub-band signals, and generating parameters that refer at least to the low frequency band signal sections which match best with high-frequency sub-band signals.

The application provides a new approach for coding the high frequency region of an input signal. The input signal can be divided into temporally successive frames. Each of the frames represents a temporal instance of the input signal. Within each frame, the input signal can be represented by its spectral components. The spectral components, or samples, represent the frequencies within the input signal.

Instead of blindly transposing the low frequency region to the high frequencies, the application maximizes the similarity between the original and the coded high frequency spectral components. According to the application, the high frequency region is formed utilizing the already-coded low frequency region of the signal.

By comparing low frequency signal samples with the high frequency sub-bands of the received signal, a signal section within the low frequency can be found, which matches best with an actual high frequency sub-band. The application provides for searching within the whole low frequency spectrum sample by sample for a signal section, which resembles best a high frequency sub-band. As a signal section corresponds to a sample sequence, the application provides, in other words, finding a sample sequence which matches best with the high frequency sub-band. The sample sequence can start anywhere within the low frequency band, except that the last considered starting point within the low frequency band should be the last sample in the low frequency band minus the length of the high frequency sub-band that is to be matched.

An index or link to the low frequency signal section matching best the actual high frequency sub-band can be used to model the high frequency sub-band. Only the index or link needs to be encoded and stored, or transmitted in order to allow restoring a representation of the corresponding high frequency sub-band at the receiving end.

According to embodiments, the most similar match, i.e. the most similar spectral shape of the signal section and the high frequency sub-band, is searched within the low frequency band. Parameters referring at least to the signal section which is found to be most similar with a high frequency sub-band are created in the encoder. The parameters may comprise scaling factors for scaling the found sections into the high frequency band. At the decoder side, these parameters are used to transpose the corresponding low frequency signal sections to a high frequency region to reconstruct the high frequency sub-bands.

Scaling can be applied to the copied low frequency signal sections using scaling factors. According to embodiments, only the scaling factors and the links to the low frequency signal sections need to be encoded.

The shape of the high frequency region follows more closely the original high frequency spectrum than with known methods when using the best matching low frequency signal sections for reproduction of the high frequency sub-bands. The perceptually important spectral peaks can be modeled more accurately, because the amplitude, shape, and frequency position is more similar to the original signal. As the modeled high frequency sub-bands can be compared with the original high frequency sub-bands, it is possible to easily detect missing spectral components, i.e. sinusoids or noise, and then add these.

To enable envelope shaping, embodiments provide utilizing the low frequency signal sections by transposing the low frequency signal samples into high-frequency sub-band signals using the parameters wherein the parameters comprise scaling factors such that an envelope of the transposed low frequency signal sections follows an envelope of the high frequency sub-band signals of the received signal. The scaling factors enable adjusting the energy and shape of the copied low frequency signal sections to match better with the actual high frequency sub-bands.

The parameters can comprise links to low frequency signal sections to represent the corresponding high frequency sub-band signals according to embodiments. The links can be pointers or indexes to the low frequency signal sections. With this information, it is possible to refer to the low frequency signal sections when constructing the high frequency sub-band.

In order to reduce the number of quantization bits, it is possible to normalize the envelope of the high frequency sub-band signals. The normalization provides that both the low and high frequency bands are within a normalized amplitude range. This reduces the number of bits needed for quantization of the scaling factors. The information used for normalization has to be provided by the encoder to construct the representation of the high frequency sub-band in the decoder. Embodiments provide envelope normalization with linear prediction coding. It is also possible to normalize the envelope utilizing cepstral modeling. Cepstral modeling uses the inverse Fourier Transform of the logarithm of the power spectrum of a signal.

Generating scaling factors can comprise generating scaling factors in the linear domain to match at least amplitude peaks in the spectrum. Generating scaling factors can also comprise matching at least energy and/or shape of the spectrum in the logarithmic domain, according to embodiments.

Embodiments provide generating signal samples within the low frequency band and/or the high frequency band using modified discrete cosine transformation (MDCT). The MDCT transformation provides spectrum coefficients preferably as real numbers. The MDCT transformation according to embodiments can be used with any suitable frame sizes, in particular with frame sizes of 2048 samples for normal frames and 256 samples for transient frames, but also any other value in between.

To obtain the low frequency signal sections which match best with corresponding high-frequency sub-band signals, embodiments provide calculating a similarity measure using a normalized correlation or the Euclidian distance.

In order to encode the input signal, embodiments provide quantizing the low frequency signal samples and quantizing at least the scaling factors. The link to the low frequency signal section can be an integer.

It is possible to add additional sinusoids to improve the quality of high frequency signals. In order to comply with such sinusoids, embodiments provide dividing the input signal into temporally successive frames, and detecting tonal sections within two successive frames within the input signal. The tonal sections can be enhanced by adding additional sinusoids. Sections which are highly tonal can be enhanced additionally by increasing the number of high frequency sub-bands in the corresponding high frequency regions. Input frames can be divided into different tonality groups, e.g. not tonal, tonal, and strongly tonal.

Detecting tonal sections can comprise using Shifted Discrete Fourier Transformation (SDFT). The result of the SDFT can be utilized within the encoder to provide the MDCT transformation.

Another aspect of the application is a method for decoding audio signals with receiving an encoded bit stream, decoding from the bit stream at least a low frequency signal and at least parameters referring to low frequency signal sections, utilizing the low frequency signal samples and the parameters referring to the low frequency signal sections for reconstructing at least two high-frequency sub-band signals, and outputting an output signal comprising at least the low frequency signal and at least the two high-frequency sub-band signals.

A further aspect of the application is an encoder for encoding audio signals comprising a receiver arranged for receiving an input audio signal, a filtering element for dividing the audio signal into at least a low frequency band and a high frequency band, and further arranged for dividing the high frequency band into at least two high frequency sub-band signals, and a coding element for generating parameters that refer at least to low frequency band signal sections which match best with the high-frequency sub-band signals.

A still further aspect of the application is an encoder for encoding audio signals comprising receiving means arranged for receiving an input audio signal, filtering means arranged for dividing the audio signal into at least a low frequency band and a high frequency band, and further arranged for dividing the high frequency band into at least two high frequency sub-band signals, and coding means arranged for generating parameters that refer at least to low frequency band signal sections which match best with the high-frequency sub-band signals.

Yet, a further aspect of the application is a Decoder for decoding audio signals comprising a receiver arranged for receiving an encoded bit stream, a decoding element arranged for decoding from the bit stream at least a low frequency signal and at least parameters referring to low frequency signal sections, and a generation element arranged for utilizing samples of the low frequency signal and the parameters referring to the low frequency signal sections for reconstructing at least two high-frequency sub-band signals.

Still a further aspect of the application is a decoder for decoding audio signals comprising receiving means arranged for receiving an encoded bit stream, decoding means arranged for decoding from the bit stream at least a low frequency signal and at least parameters referring to the low frequency signal sections, generation means arranged for utilizing samples of the low frequency signal and the parameters referring to the low frequency signal sections for reconstructing at least two high-frequency sub-band signals.

A further aspect of the application is a system for digital audio compression comprising a described decoder, and a described encoder.

Yet, a further aspect of the application relates to a computer readable medium having a program stored thereon for encoding audio signals, the program comprising instructions operable to cause a processor to receive an input audio signal, divide the audio signal into at least a low frequency band and a high frequency band, divide the high frequency band into at least two high frequency sub-band signals, and generate parameters that refer at least to low frequency band signal sections which match best with high-frequency sub-band signals.

Also, a computer readable medium having a program stored thereon for decoding bit streams, the program comprising instructions operable to cause a processor to receive an encoded bit stream, decode from the bit stream at least a low frequency signal and at least parameters referring to the low frequency signal sections, utilize samples of the low frequency signal and the parameters referring to the low frequency signal sections for reconstructing at least two high-frequency sub-band signals, and put out an output signal comprising at least the low frequency signal and at least two high-frequency sub-band signals.

DETAILED DESCRIPTION OF THE FIGURES

Figure 1:
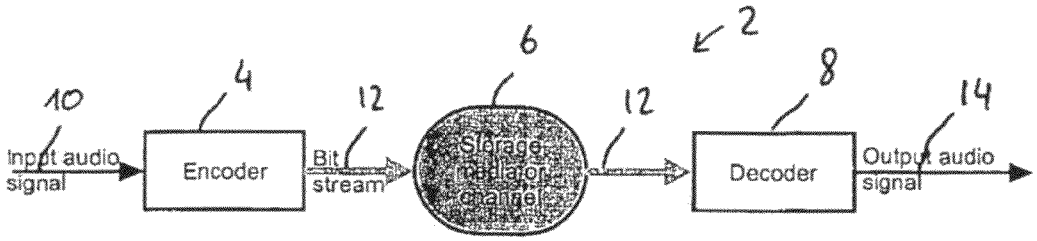
FIG. 1 a system for coding audio signals according to the art.

General audio coding systems consist of an encoder and a decoder, as illustrated in schematically FIG. 1. Illustrated is a coding system 2 with an encoder 4, a storage medium or media channel 6 and a decoder 8.

The encoder 4 compresses an input audio signal 10 producing a bit stream 12, which is either stored or transmitted through the media channel 6. The bit stream 12 can be received within the decoder 8. The decoder 8 decompresses the bit stream 12 and produces an output audio signal 14. The bit rate of the bit stream 12 and the quality of the output audio signal 14 in relation to the input signal 10 are the main features which define the performance of the coding system 2.

Figure 2:
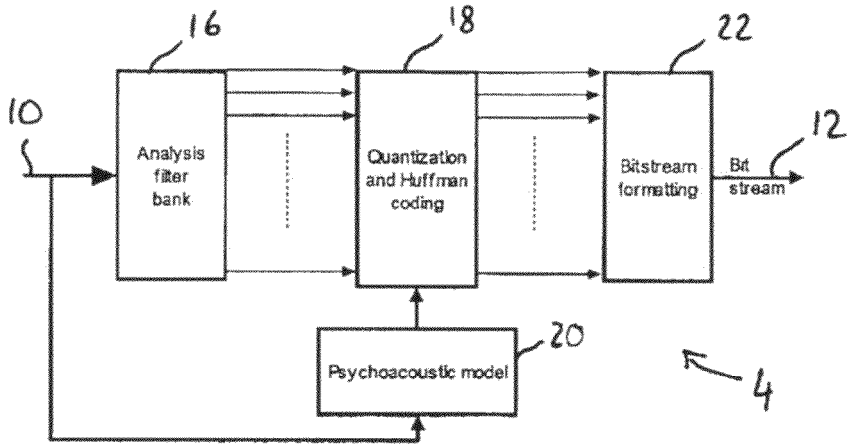
FIG. 2 an encoder according to the art.

A typical structure of a modern audio encoder 4 is presented schematically in FIG. 2. The input signal 10 is divided into sub-bands using an analysis filter bank structure, filtering means or filtering element 16. Each sub-band can be quantized and coded within coding means or element 18 utilizing the information provided by a psychoacoustic model 20. The coding can be Huffman coding. The quantization setting as well as the coding scheme can be dictated by the psychoacoustic model 18. The quantized, coded information is used within a bit stream formatter or formatting means 22 for creating a bit stream 12.

Figure 3:
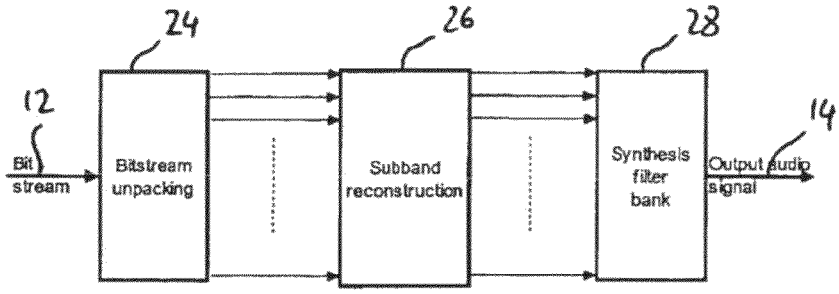
FIG. 3 a decoder according to the art.

The bit stream 12 can be decoded within a decoder 8 as illustrated schematically in FIG. 3. The decoder 8 can comprise bit stream unpacking means or element 24, sub-band reconstruction means or element 26, and a synthesis filter bank, filtering element, or filtering means 28.

The decoder 8 computes the inverse of the encoder 4 and transforms the bit stream 12 back to an output audio signal 14. During the decoding process, the bit stream 12 is de-quantized in the sub-band reconstruction means 26 into sub-band signals. The sub-band signals are fed to the synthesis filter bank 28, which synthesizes the audio signal from the sub-band signals and creates the output signal 14.

It is in many cases possible to efficiently and with perceptual accuracy synthesize the high frequency region using only the low frequency region and a limited amount of additional control information. Optimally, the coding of the high frequency part only requires a small number of control parameters. Since the whole upper part of the spectrum can be synthesized with a small amount of information, considerable savings can be achieved in the total bit rate.

Current coding techniques, such as MP3pro, utilize these properties in audio signals by introducing an SBR coding scheme in addition to the psychoacoustic coding. In SBR, the high frequency region can be generated separately utilizing the coded low frequency region, as illustrated schematically in FIGS. 4 and 5.

Figure 4:
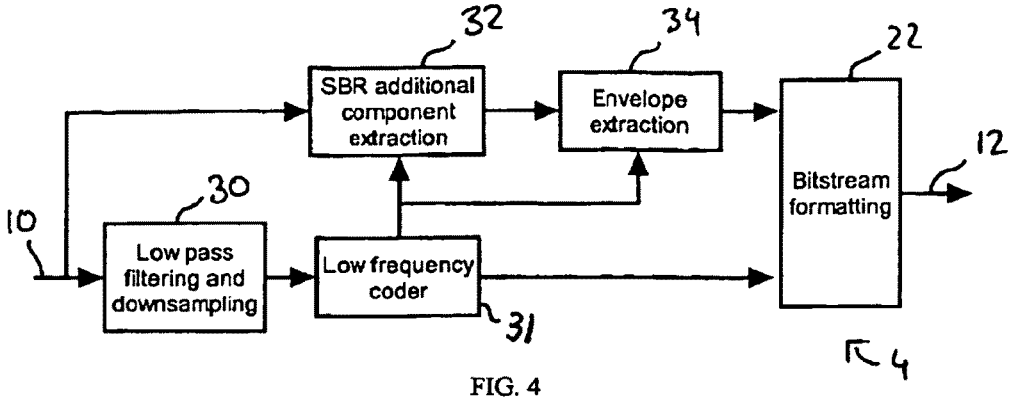
FIG. 4 an SBR encoder.

FIG. 4 illustrates schematically an encoder 4. The encoder 4 comprises low pass filter, filtering means or filtering element 30, coding means or a coding element 31, an SBR element or means 32, an envelope extraction means or element 34 and bit stream formatter means or element 22.

Figure 6:
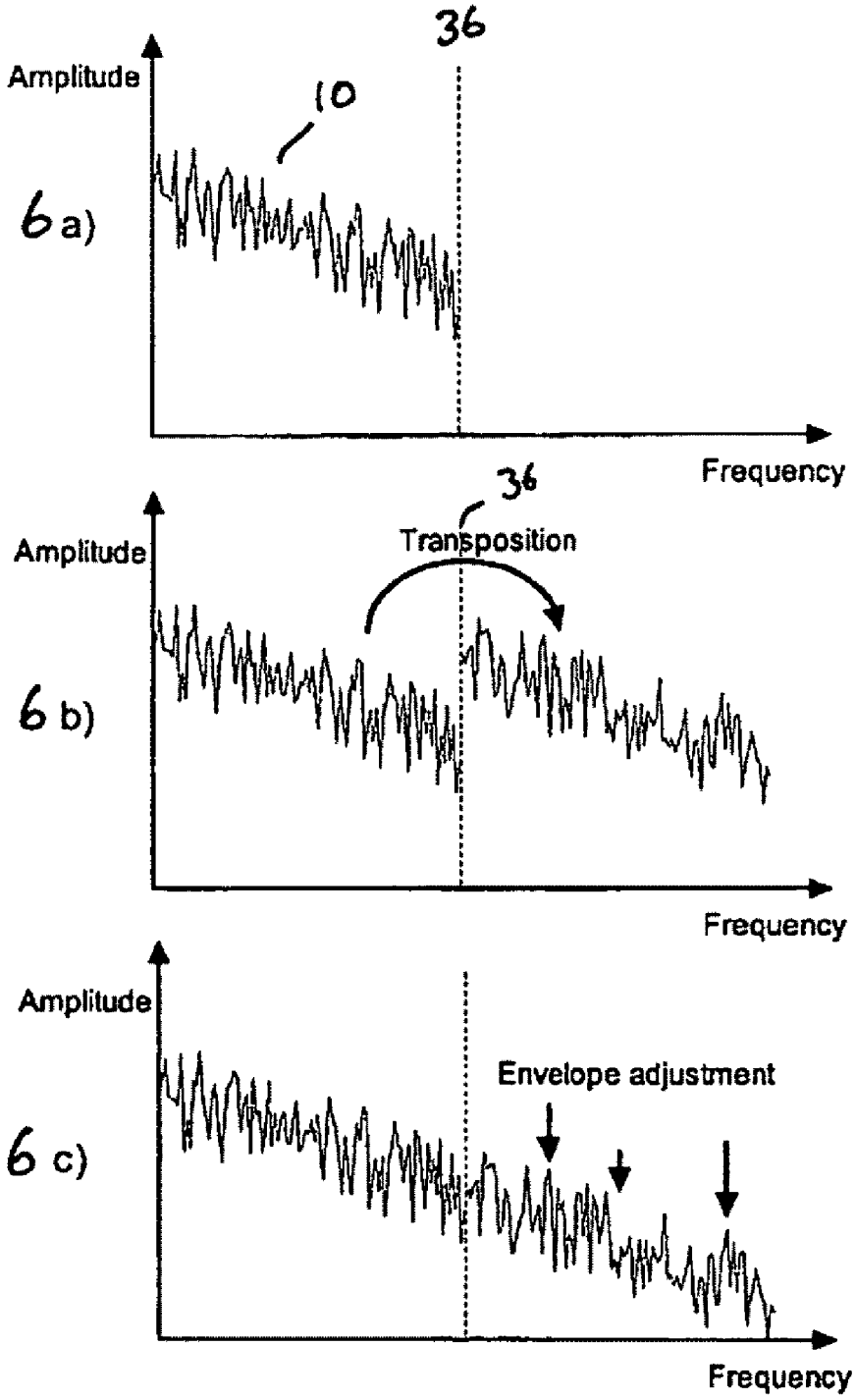
FIG. 6 spectral representation of an audio signal in different stages labeled FIGS. 6*a*), 6*b*) and 6*c*)

The low pass filter 30 first defines a cut-off frequency up to which the input signal 10 is filtered. The effect is illustrated in FIG. 6*a*. Only frequencies below the cut-off frequency 36 pass the filter.

The coding means or element 31 carry out quantization and Huffman coding with thirty-two low frequency sub-bands. The low frequency contents are converted within the coding element or means 31 into the QMF domain. The low frequency contents are transposed based on the output of coder 31. The transposition is done in SBR element or means 32. The effect of transposition of the low frequencies to the high frequencies is illustrated within FIG. 6*b*. The transposition is performed blindly such that the low frequency sub-band samples are just copied into high frequency sub-band samples. This is done similarly in every frame of the input signal and independently of the characteristics of the input signal.

In the SBR element or means 32, the high frequency sub-bands can be adjusted based on additional information. This is done to make particular features of the synthesized high frequency region more similar with the original one. Additional components, such as sinusoids or noise, can be added to the high frequency region to increase the similarity with the original high frequency region. Finally, the envelope is adjusted in envelope extraction means 34 to follow the envelope of the original high frequency spectrum. The effect can be seen in FIG. 6*c*, where the high frequency components are scaled to be more closely to the actual high frequency components of the input signal.

Within bit stream 12 the coded low frequency signal together with scaling and envelope adjustment parameters is comprised. The bit stream 12 can be decoded within a decoder as illustrated in FIG. 5.

Figure 5:
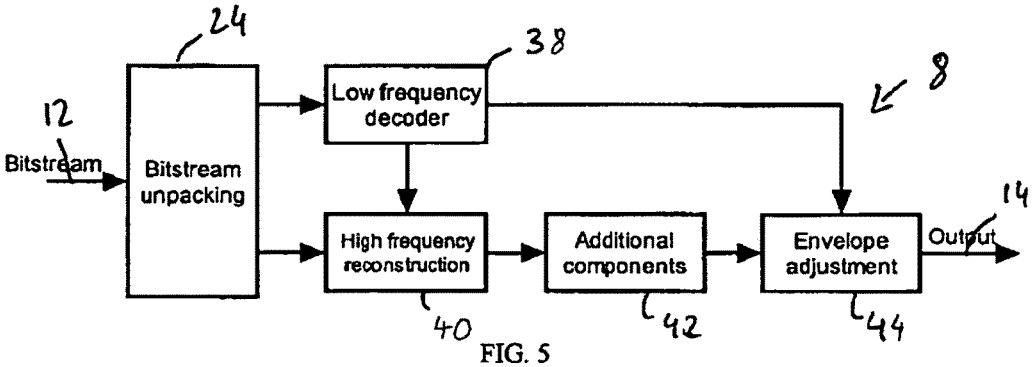
FIG. 5 an SBR decoder.

FIG. 5 illustrates a decoder 8 with an unpacking element or means 24, a low frequency decoder or decoding means 38, high frequency reconstruction element or means 40, component adjustment device or means 42, and envelope adjustment element or means 44. The low frequency sub-bands are reconstructed in the decoder 38. From the low frequency sub-bands, the high frequency sub-bands are statically reconstructed within the high frequency reconstruction element or means 40. Sinusoids can be added and the envelope adjusted in the component adjustment device or means 42, and the envelope adjustment element or means 44.

According to the application, the transposition of low frequency signal samples into high frequency sub-bands is done dynamically, e.g. it is checked which low frequency signal sections match best with a high frequency sub-band. An index to the corresponding low frequency signal sections is created. This index is encoded and used within the decoder for constructing the high frequency sub-bands from the low frequency signal.

Figure 7:
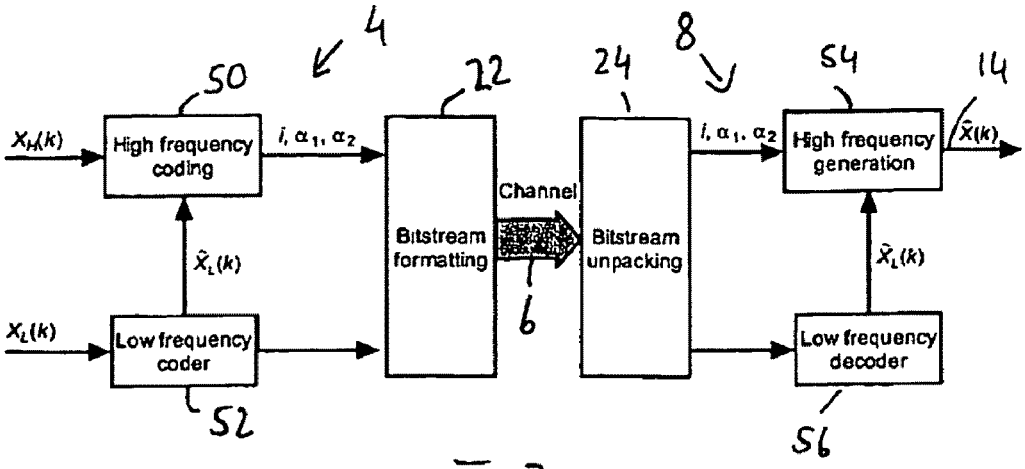
FIG. 7 a system according to a first embodiment.

FIG. 7 illustrates a coding system with an encoder 4 and a decoder 8. The encoder 4 is comprised of a high frequency coder or coding means 50, a low frequency coder or coding means 52, and bit stream formatter or formatting means 22. The encoder 4 can be part of a more complex audio coding scheme. The application can be used in almost any audio coder in which good quality is aimed for at low bit rates. For instance the application can be used totally separated from the actual low bit rate audio coder, e.g. it can be placed in front of a psychoacoustic coder, e.g. AAC, MPEG, etc.

As the high frequency region typically contains similar spectral shapes as the low frequency region, good coding performance is generally achieved. This is accomplished with a relatively low total bit rate, as only the indexes of the copied spectrum and the scaling factors need to be transmitted to the decoder.

Within the low frequency coder 52, the low frequency samples $X_L(k)$ are coded. Within the high frequency coder 50, parameters $\alpha_1$, $\alpha_2$, i representing transformation, scaling and envelope forming are created for coding, as will be described in more detail below.

The high frequency spectrum is first divided into $n_b$ sub-bands. For each sub-band, the most similar match (i.e. the most similar spectrum shape) is searched from the low frequency region.

The method can operate in the modified discrete cosine (MDCT) domain. Due its good properties (50% overlap with critical sampling, flexible window switching etc.), the MDCT domain is used in most state-of-the-art audio coders. The MDCT transformation is performed as:

$$X(k) = \sum_{n=0}^{2N-1} h(n)x(n)\cos\left[\frac{2\pi}{N}\left(k+\frac{1}{2}\right)\left(n+\frac{1}{2}+\frac{N}{2}\right)\right], \tag{1}$$

where x(n) is the input signal, h(n) is the time analysis window with length 2N, and $0 \leqq k < N$. Typically in audio coding N is 1024 (normal frames) or 128 samples (transients). The spectrum coefficients X(k) can be real numbers. Frame sizes as mentioned, as well as any other frame size are possible.

To create the parameters describing the high frequency sub-bands, it is necessary to find the low frequency signal sections, which match best the high frequency sub-bands within the high frequency coder 50. The high frequency coder 50 and the low frequency coder 52 can create N MDCT coded components, where $X_L(k)$ represents the low frequency components and $X_H(k)$ represent the high frequency components.

With the low frequency coder 52, $N_L$ low frequency MDCT coefficients $\hat{X}_L(k)$, $0 \leqq k < N_L$ can be coded. Typically $N_L = N/2$, but also other selections can be done.

Utilizing $\hat{X}_L(k)$ and the original spectrum X(k), the target is to create a high frequency component $\hat{X}_H(k)$ which is, with the used measures, maximally similar with the original high frequency signal $X_H(k) = X(N_L + k)$, $0 \leqq k < N - N_L$. $\hat{X}_L(k)$ and $\hat{X}_H(k)$ form together the synthesized spectrum $\hat{X}(k)$:

$$\hat{X}(k) = \begin{cases} \hat{X}_L(k), & 0 \le k < N_L \\ \hat{X}_H(k), & N_L \le k < N. \end{cases} \tag{2}$$

The original high frequency spectrum $X_H(k)$ is divided into $n_b$ non-overlapping bands. In principle, the number of bands as well as the width of the bands can be chosen arbitrarily. For example, eight equal width frequency bands can be used when N equals to 1024 samples. Another reasonable choice is to select the bands based on the perceptual properties of human hearing. For example Bark or equivalent rectangular bandwidth (ERB) scales can be utilized to select the number of bands and their widths.

Within the high frequency coder, the similarity measure between the high frequency signal and the low frequency components can be calculated.

Let $X_H^j$ be a column vector containing the jth band of $X_H(k)$ with length of $w_j$ samples. $X_H^j$ can be compared with the coded low frequency spectrum $\hat{X}_L(k)$ as follows:

$$\max_{i(j)}\left(S\left(\hat{X}_L^{i(j)}, X_H^j\right)\right), \; 0 \le i(j) < N_L - w_j, \tag{3}$$

where S(a, b) is a similarity measure between vectors a and b, and $\hat{X}_L^{i(j)}$ is a vector containing indexes $i(j) \leqq k < i(j) + w_j$ of the coded low frequency spectrum $\hat{X}_L(k)$. The length of the desired low frequency signal section is the same as the length of the current high frequency sub-band, thus basically the only information needed is the index i(j), which indicates where a respective low frequency signal section begins.

The similarity measure can be used to select the index i(j) which provides the highest similarity. The similarity measure is used to describe how similar the shapes of the vectors are, while their relative amplitude is not important. There are many choices for the similarity measure. One possible implementation can be the normalized correlation:

$$S(a, b) = \left|\frac{b^T a}{\sqrt{a^T a}}\right|, \tag{4}$$

which provides a measure that is not sensitive to the amplitudes of a and b. Another reasonable alternative is a similarity measure based on Euclidian distance:

$$S(a, b) = \frac{1}{\|a - b\|}. \tag{5}$$

Correspondingly, many other similarity measures can be utilized as well.

These most similar sections within the low frequency signal samples can be copied to the high frequency sub-bands and scaled using particular scaling factors. The scaling factors take care that the envelope of the coded high frequency spectrum follows the envelope of the original spectrum.

Using the index i(j), a selected vector $\hat{X}_L^{i(j)}$, most similar in shape with the $X_H^j$ has to be scaled to the same amplitude as $X_H^j$. There are many different techniques for scaling. For example, scaling can be performed in two phases, first in the linear domain to match the high amplitude peaks in the spectrum and then in the logarithmic domain to match the energy and shape. Scaling the vector $\hat{X}_L^{i(j)}$ with these scaling factors results in the coded high frequency component $\hat{X}_H^j$.

The linear domain scaling is performed simply as $$\hat{X}_H^j=\alpha_1(j)\hat{X}_L^{i(j)}, \tag{6}$$

where $\alpha_1(j)$ is obtained from $$\alpha_1(j)=\frac{\left(\hat{X}_L^{i(j)}\right)^T X_H^j}{\left(\hat{X}_L^{i(j)}\right)^T \hat{X}_L^{i(j)}}. \tag{7}$$

Notice, that $\alpha_1(j)$ can get both positive and negative values. Before logarithmic scaling, the sign of vector samples as well as the maximum logarithmic value of $\hat{X}_H^j$ can be stored:

$$K_{\hat{X}_H^j}=\frac{\hat{X}_H^j}{\left|\hat{X}_H^j\right|} \tag{8}$$

$$M_{\hat{X}_H^j}=\max\left(\log_{10}\left|\hat{X}_H^j\right|\right) \tag{9}$$

Now, the logarithmic scaling can be performed and $\hat{X}_H^j$ is updated as $$V_{\hat{X}_H^j}=\alpha_2(j)(\log_{10}(|\hat{X}_H^j|)-M_{\hat{X}_H^j})+M_{\hat{X}_H^j}, \tag{10}$$

$$\hat{X}_H^j=10^{V_{\hat{X}L}^i}(K_{\hat{X}di\,H^j})^T, \tag{11}$$

where the scaling factor $\alpha_2(j)$ is obtained from $$\alpha_2(j)=\frac{\left(\log_{10}\left(\left|\hat{X}_H^j\right|\right)-M_{\hat{X}_H^j}\right)^T\left(\log_{10}(|X_H^j|)-M_{\hat{X}_H^j}\right)}{\left(\log_{10}\left(\left|\hat{X}_H^j\right|\right)-M_{\hat{X}_H^j}\right)^T\left(\log_{10}(|\hat{X}_H^j|)-M_{\hat{X}_H^j}\right)}. \tag{12}$$

This scaling factor maximizes similarity between waveforms in the logarithmic domain. Alternatively, $\alpha_2(j)$ can be selected such that the energies are set to the approximately equal level:

$$\alpha_2(j)=\frac{\left\|\log_{10}(X_H^j)-M_{\hat{X}_H^j}\right\|}{\left\|\log_{10}\left(\hat{X}_H^j\right)-M_{\hat{X}_H^j}\right\|}. \tag{13}$$

In the above equations, the purpose of the variable $M_{\hat{X}_H^j}$ is to make sure that the amplitudes of the largest values in $\hat{X}_H^j$ (i.e. the spectral peaks) are not scaled too high (the first scaling factor $\alpha_1(j)$ did already set them to the correct level). Variable $K_{\hat{X}_H^j}$ is used to store the sign of the original samples, since that information is lost during transformation to the logarithmic domain.

After the bands have been scaled, the synthesized high frequency spectrum $\hat{X}_H(k)$ can be obtained by combining vectors $\hat{X}_H^j$, j=0, 1, . . . , $n_b-1$.

After the parameters have been selected, the parameters need to be quantized for transmitting the high frequency region reconstruction information to the decoder 8.

To be able to reconstruct $\hat{X}_H(k)$ in the decoder 8, parameters i(j), $\alpha_1(j)$ and $\alpha_2(j)$ are needed for each band. In the decoder 8, a high frequency generation element or means 54 utilize these parameters. Since index i(j) is an integer, it can be submitted as such. $\alpha_1(j)$ and $\alpha_2(j)$ can be quantized using for example a scalar or vector quantization.

The quantized versions of these parameters, $\hat{\alpha}_1(j)$, and $\hat{\alpha}_2(j)$, are used in the high frequency generation element or means 54 to construct $\hat{X}_H(k)$ according to equations (6) and (10).

A low frequency decoding element or means 56 decodes the low frequency signal and together with the reconstructed high frequency sub-bands form the output signal 14 according to equation 2.

The system as illustrated in FIG. 7 may further be enhanced with an envelope normalization element or means for envelope normalization. The system illustrated in FIG. 8 comprises in addition to the system illustrated in FIG. 7 envelope normalization element or means for envelope normalization 58 as well as an envelope synthesis element or means 60.

In this system, the high frequency coding technique is used to generate an envelope-normalized spectrum using the envelope normalization element or means 58 in the encoder 4. The actual envelope synthesis is performed in a separate envelope synthesis element or means 60 in the decoder 8.

Figure 8:
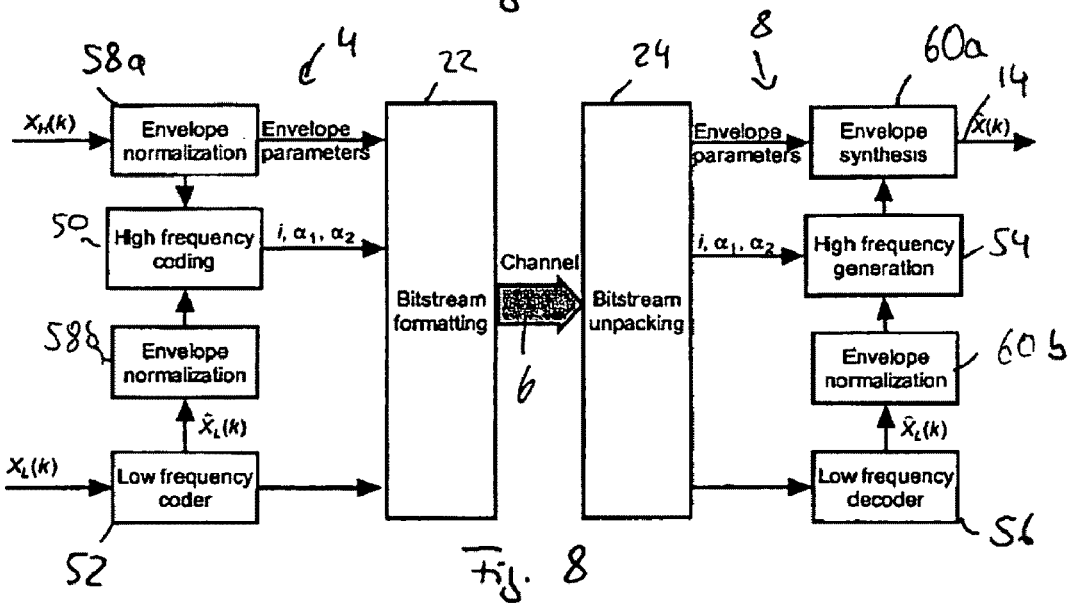
FIG. 8 a system according to a second embodiment.
Figure 9:
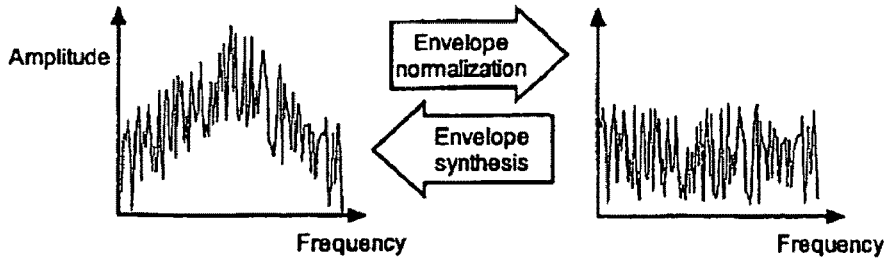
FIG. 9 a frequency spectrum with envelope normalization.

The envelope normalization can be performed utilizing, for example, LPC-analysis or cepstral modeling. It should be noted that with envelope normalization, envelope parameters describing the original high frequency spectral envelope have to be submitted to the decoder, as illustrated in FIG. 8.

In SBR, additional sinusoids and noise components are added to the high frequency region. It is possible to do the same also in the above described application. If necessary, such additional components can be added easily. This is because in the described method it is possible to measure the difference between the original and synthesized spectra and thus to find locations where there are significant differences in the spectral shape. Since, for example, in common BWE coders the spectral shape differs significantly from the original spectrum it is typically more difficult to decide whether additional sinusoidal or noise components should be added.

It has been noticed that in some cases when the input signal is very tonal, the quality of the coded signal may decrease when compared to the original. This is because the coded high frequency region may not remain as periodic from one frame to another as in the original signal. The periodicity is lost since some periodic (sinusoidal) components may be missing or the amplitude of the existing periodic components varies too much from one frame to another.

To include tonal sections even when the low frequency signal samples used for reconstructing the high frequency sub-bands do not represent the entire sinusoidal, two further steps can be provided.

In a first step, the tonal signal sections with possible quality degradations can be detected. The tonal sections can be detected by comparing the similarities between two successive frames in the Shifted Discrete Fourier Transform (SDFT) domain. SDFT is a useful transformation for this purpose, because it contains also phase information, but is still closely related to the MDCT transformation, which is used in the other parts of the coder.

Tonality detection can be performed right after transient detection and before initializing the actual high frequency region coding. Since transient frames do generally not contain tonal components, tonality detection can be applied only when both present and previous frames are normal long frames (e.g. 2048 samples).

The tonality detection is based on Shifted Discrete Fourier Transform (SDFT), as indicated above, which can be defined for 2N samples long frames as:

$$Y(k) = \sum_{n=0}^{2N-1} h(n)x(n)\exp(i2\pi(n+u)(k+v)/2N), \tag{14}$$

where h(n) is the window, x(n) is the input signal, and u and v represent time and frequency domain shifts, respectively. These domain shifts can be selected such that u=(N+1)/2 and v=½, since then it holds that X(k)=real(Y(k)).

Thus, instead of computing SDFT and MDCT transformations separately, the SDFT transformation can be computed first for the tonality analysis and then the MDCT transformation is obtained straightforwardly as a real part of the SDFT coefficients. This way the tonality detection does not increase computational complexity significantly.

With $Y(k)_b$ and $Y(k)_{b-1}$ representing the SDFT transformation of current and previous frames, respectively, the similarity between frames can be measured using:

$$S = \frac{\sum_{k=N_L+1}^{N} (|Y_b(k)| - |Y_{b-1}(k)|)^2}{\sum_{k=N_L+1}^{N} (|Y_b(k)|)^2}, \tag{15}$$

where $N_{L+}1$ corresponds to the limit frequency for high frequency coding. The smaller the parameter S is, the more similar the high frequency spectrums are. Based on the value of S, frames can be classified as follows:

$$\text{TONALITY} = \begin{cases} \text{STRONGLY TONAL}, & 0 \le S < s_{lim1} \\ \text{TONAL}, & s_{lim1} \le S < s_{lim2} \\ \text{NOT TONAL}, & s_{lim2} \le S. \end{cases} \tag{16}$$

Good choices for the limiting factors slim1 and slim2 are 0.02 and 0.2, respectively. However, also other choices can be made. In addition, different variants can be used and, for example, one of the classes can be totally removed.

Figure 10:
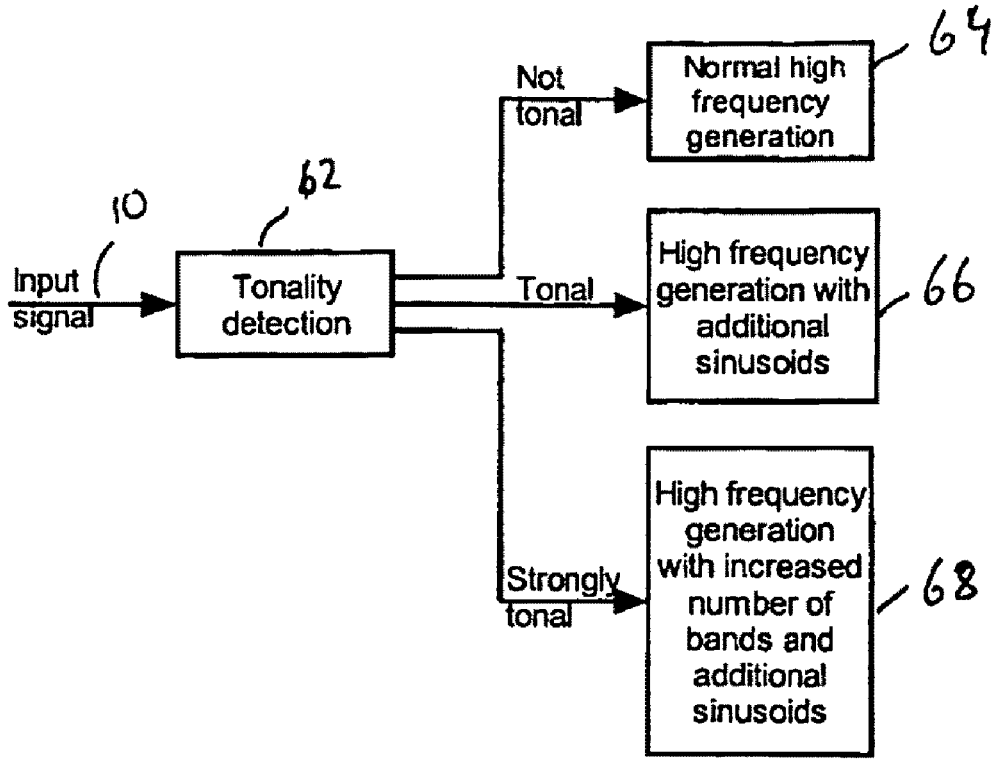
FIG. 10 coding enhancement using tonal detection.

As illustrated in FIG. 10, the tonal detection as described above can be carried out based on the input signal 10 which may be carried out in a corresponding hardware device or by a processor according to program instructions stored on a computer readable medium.

Based on the tonality detection (62), the input frames are divided into three groups: not tonal (64), tonal (66) and strongly tonal (68), as illustrated in FIG. 10.

After tonal detection (62), in a second step the quality of the tonal sections can be improved by adding additional sinusoids to the high frequency region and possibly by increasing the number of high frequency sub-bands used to create the high frequency region as described above.

The most typical case is that the signal is not tonal (64), and then the coding is continued as described above.

If the input signal is classified as tonal (66), additional sinusoids can be added to the high frequency spectrum after applying the coding as illustrated above. A fixed number of sinusoids can be added to the MDCT domain spectrum. The sinusoids can straightforwardly be added to the frequencies where the absolute difference between the original and the coded spectrum is largest. The positions and amplitudes of the sinusoids are quantized and submitted to the decoder.

When a frame is detected to be tonal (or strongly tonal), sinusoids can be added to the high frequency region of the spectrum. With $X_H(k)$ and $\hat{X}_H(k)$ representing the original and coded high frequency sub-band components, respectively, the first sinusoid can be added to index $k_1$, which can be obtained from $$\max_{k_i} \left| X_H(k_i) - \hat{X}_H(k_i) \right|. \tag{17}$$

The amplitude (including its sign) of the sinusoid can be defined as $$A_i = X_H(k_i) - \hat{X}_H(k_i). \tag{18}$$

Finally, $\hat{X}_H(k)$ can be updated as $$\hat{X}_H(k_i) = \hat{X}_H(k_i) + A_i. \tag{19}$$

Equations (17)-(19) can be repeated until a desired number of sinusoids have been added. Typically, already four additional sinusoids can result in clearly improved results during tonal sections. The amplitudes of the sinusoids $A_i$ can be quantized and submitted to the decoder 8. The positions $k_i$ of the sinusoids can also be submitted. In addition, the decoder 8 can be informed that the current frame is tonal.

It has been noticed that during tonal sections the second scaling factor $\alpha_2$ may not improve the quality and may then be eliminated.

When a strongly tonal section (68) is detected, it is known that the current section is particularly challenging for high frequency region coding. Therefore, adding just sinusoids may not be enough. The quality can be further improved by increasing the accuracy of the high frequency coding. This can be performed by adding the number of bands used to create the high frequency region.

During strongly tonal sections, the high frequency sub-bands remain very similar from one frame to another. To maintain this similarity also in the coded signal, special actions can be applied. Especially if the number of high frequency sub-bands $n_b$ is relatively low (i.e. 8 or below), the number of high frequency sub-bands can be increased to higher rates. For example, 16 high frequency sub-bands generally provide performance that is more accurate.

In addition to a high number of bands, also a high number of sinusoids can be added. In general, a good solution is to use two times as many sinusoids as during "normal" tonal sections.

Increasing the number of high frequency sub-bands as well as increasing the number of sinusoids easily doubles the bit rate of strongly tonal sections when compared to "normal" frames. However, strongly tonal sections are a very special case and do occur very rarely, thus the increase to the average bit rate is very small.

Although only a few exemplary embodiments have been described in detail above, those skilled in the art will readily appreciate that many modifications are possible in the exemplary embodiments without materially departing from the novel teachings and advantages hereof. Accordingly, all such modifications are intended to be included within the scope of the invention as defined in the following claims. In the claims, means-plus-function clauses are intended to cover the structures described herein as performing the recited function and not only structural equivalents, but also equivalent structures.

Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. Section 112, paragraph 6 for any limitations of any of the claims herein, except for those in which the claim expressly uses the words "means for" together with an associated function.

The invention claimed is:

1. A method comprising:

dividing an audio signal into at least one low frequency band and a high frequency band, dividing the high frequency band into at least two high frequency sub-band signals, determining within the at least one low frequency band signal sections which match best with high-frequency sub-band signals, generating parameters that refer at least to the at least one low frequency band signal sections which match best with high-frequency sub-band signals, dividing the input audio signal into temporally successive frames, detecting tonal sections within two successive frames within the input signal, and adding sinusoids to tonal sections.

2. Method of claim 1, wherein generating parameters further comprises generating at least one scaling factor for scaling the low frequency band signal sections.

3. Method of claim 2, wherein the scaling factor is generated such that an envelope of the low frequency signal sections being transposed into the high-frequency sub-band signals using the parameters follows an envelope of the high frequency sub-band signal of the received signal.

4. Method of claim 2, wherein generating scaling factors comprises generating scaling factors in the linear domain to match at least amplitude peaks in the spectrum.

5. Method of claim 2, wherein generating scaling factors comprises generating scaling factors in the logarithmic domain to match at least energy and/or shape of the spectrum.

6. Method of claim 2, further comprising quantizing samples of the low frequency signal and quantizing at least the scaling factors.

7. Method of claim 1, wherein generating parameters comprises generating links to low frequency signal sections which represent the corresponding high frequency sub-band signals.

8. Method of claim 1, wherein determining within the low frequency band signal sections which match best with high-frequency sub-band signals comprises using at least one of A) normalized correlation, B) Euclidian distance.

9. Method of claim 1, wherein at least samples of the low frequency signal sections are generated using modified discrete cosine transformation.

10. Method of claim 1, further comprising normalizing the envelope of the high frequency sub-band signals.

11. Method of claim 1, wherein detecting tonal sections comprises using Shifted Discrete Fourier Transformation.

12. Method of claim 1, further comprising increasing the number of high frequency sub-bands for tonal sections.

13. An apparatus comprising a processor;

memory including computer program code, the memory and the computer program code configured to, with the processor, cause the apparatus at least to perform:

divide an audio signal into at least one low frequency band and a high frequency band, divide the high frequency band into at least two high frequency sub-band signals, determine within the at least one low frequency band signal sections which match best with high-frequency sub-band signals, generate parameters that refer at least to the low frequency band signal sections which match best with high-frequency sub-band signals, divide the input audio signal into temporally successive frames, detect tonal sections within two successive frames within the input signal, and add sinusoids to tonal sections.

14. Apparatus of claim 13, the memory and the computer program code configured to, with the processor, cause the apparatus to generate at least one scaling factor for scaling the low frequency band signal sections.

15. Apparatus of claim 13, the memory and the computer program code configured to, with the processor, cause the apparatus to generate the scaling factor such that an envelope of the low frequency signal sections being transposed into high-frequency sub-band signals using the parameters follows an envelope of the high frequency sub-band signals of the received signal.

16. Apparatus of claim 13, the memory and the computer program code configured to, with the processor, cause the apparatus to detect tonal sections using Shifted Discrete Fourier Transformation.

17. Apparatus of claim 13, the memory and the computer program code configured to, with the processor, cause the apparatus to increase the number of high frequency sub-bands for tonal sections.

18. System comprising:

an apparatus according to claim 13; and an apparatus comprising:

a processor;

memory including computer program code, the memory and the computer program code configured to, with the processor, cause the apparatus at least to perform:

decode from an encoded bit stream at least one low frequency signal and at least parameters referring to low frequency signal sections and to sinusoids, utilize samples of the at least one low frequency signal and the parameters referring to the low frequency signal sections and to sinusoids for reconstructing at least two high-frequency sub-band signals, and provide a signal comprising at least the at least one low frequency signal and at least two high-frequency sub-band signals, the at least two high-frequency sub-bands being reconstructed from the at least one decoded low frequency signal and the parameters.

19. Non-transitory computer readable medium including a computer program configured to, with a processor, cause an apparatus to:

divide an audio signal into at least one low frequency band and a high frequency band, divide the high frequency band into at least two high frequency sub-band signals, generate parameters that refer at least to low frequency band signal sections which match best with high-frequency sub-band signals divide the input signal into temporally successive frames, detect tonal sections within two successive frames within the input signal, and add sinusoids to tonal sections.

20. The non-transitory computer readable medium of claim 19, wherein the computer program is configured to, with the processor, cause the apparatus to: use Shifted Discrete Fourier Transformation for detecting tonal sections.

21. The non-transitory computer readable medium of claim 19, wherein the computer program is configured to, with the processor, cause the apparatus to: increase the number of high frequency sub-bands for tonal sections.

22. An apparatus comprising a filter means for dividing an audio signal into at least one low frequency band and a high frequency band, and further for dividing the high frequency band into at least two high frequency sub-band signals, a coding means for generating parameters that refer at least to low frequency band signal sections within the at least one low frequency band which match best with the high-frequency sub-band signals, means for dividing the audio signal into temporally successive frames, means for detecting tonal sections within two successive frames within the input signal, and means for adding sinusoids to tonal sections.

* * * * *

UNITED STATES PATENT AND TRADEMARK OFFICE

CERTIFICATE OF CORRECTION

PATENT NO. : 8,326,638 B2
APPLICATION NO. : 12/084677
DATED : December 4, 2012
INVENTOR(S) : Tammi It is certified that error appears in the above-identified patent and that said Letters Patent is hereby corrected as shown below:

In the Specifications:

Column 8,

Lines 19, 20, 63, and 64, " $X_H^j$ " should read -- $\mathbf{X}_H^j$ --;

Lines 29 and 62, " $\widehat{X}_L^{i(j)}$ " should read -- $\widehat{\mathbf{X}}_L^{i(j)}$ --.

Column 9,

Line 1, " $\widehat{X}_L^{i(j)}$ " should read -- $\widehat{\mathbf{X}}_L^{i(j)}$ --;

Lines 2, 5, 16, 26, 53, and 61, " $\widehat{X}_H^j$ " should read -- $\widehat{\mathbf{X}}_H^j$ --;

Lines 28-33, " $V_{\hat{X}_H^j}=\alpha_2(j)(\log_{10}(|\hat{X}_H^j|)-M_{\hat{X}_H^j})+M_{\hat{X}_H^j}$, $\hat{X}_H^j=10^{V_{\hat{X}_H^j}}(K_{\hat{X}_H^j})^T$, " should read -- $\mathbf{V}_{\tilde{\mathbf{X}}_H^j}=\alpha_2(j)(\log_{10}(|\tilde{\mathbf{X}}_H^j|)-M_{\tilde{\mathbf{X}}_H^j})+M_{\tilde{\mathbf{X}}_H^j}$, $\tilde{\mathbf{X}}_H^j=10^{\mathbf{V}_{\tilde{\mathbf{X}}_H^j}}(\mathbf{K}_{\tilde{\mathbf{X}}_H^j})^T$, --;

Line 52, " $M_{\hat{X}_H^j}$ " should read -- $M_{\tilde{\mathbf{X}}_H^j}$ --;

Line 56, " $K_{\hat{X}_H^j}$ " should read -- $\mathbf{K}_{\tilde{\mathbf{X}}_H^j}$ --.

Signed and Sealed this
Eleventh Day of June, 2013

Teresa Stanek Rea
*Acting Director of the United States Patent and Trademark Office*